US009797072B2

(12) United States Patent
Ranawaka et al.

(10) Patent No.: US 9,797,072 B2
(45) Date of Patent: Oct. 24, 2017

(54) METHOD OF MANUFACTURING FRAYING-FREE COTTON ELASTANE WEFT KNIT FABRIC

(71) Applicant: Textured Jersey Lanka PLC, Avissawella (LK)

(72) Inventors: Haritha Ranawaka, Avissawella (LK); Somasiri Manage, Avissawella (LK); Hareendra Indiwara, Avissawella (LK); Asanka Rodrigo, Avissawella (LK)

(73) Assignee: Textured Jersey Lanka PLC, Avissawella (LK)

( * ) Notice: Subject to any disclaimer, the term of this patent is extended or adjusted under 35 U.S.C. 154(b) by 545 days.

(21) Appl. No.: 14/476,933

(22) Filed: Sep. 4, 2014

(65) Prior Publication Data

US 2015/0059137 A1 Mar. 5, 2015

Related U.S. Application Data

(60) Provisional application No. 61/873,413, filed on Sep. 4, 2013.

(51) Int. Cl.
*D04B 1/18* (2006.01)
*D02G 1/02* (2006.01)
*D02G 3/32* (2006.01)

(52) U.S. Cl.
CPC ..... *D04B 1/18* (2013.01); *D02G 1/02* (2013.01); *D02G 3/328* (2013.01); *D10B 2201/02* (2013.01)

(58) Field of Classification Search
CPC ..... D04B 1/18; D04B 1/20; D04B 7/16
USPC ..... 66/202, 192, 193
See application file for complete search history.

(56) References Cited

U.S. PATENT DOCUMENTS 3,971,234 A * 7/1976 Taylor ..... D04B 1/18 66/172 E
5,198,288 A * 3/1993 Grunfeld ..... D04B 1/18 442/306
5,687,587 A * 11/1997 Michel ..... D04B 1/18 66/196
6,776,014 B1 * 8/2004 Laycock ..... D04B 1/18 442/306
7,040,124 B1 * 5/2006 Miller, III ..... D04B 1/18 66/202
7,240,522 B2 * 7/2007 Kondou ..... D04B 1/18 66/195
7,465,683 B2 * 12/2008 McMurray ..... D04B 21/04 442/152
7,578,148 B2 * 8/2009 McMurray ..... D04B 21/18 66/172 E
7,611,999 B2 * 11/2009 McMurray ..... D04B 1/102 442/304
7,634,924 B2 * 12/2009 Chuang ..... D04B 1/18 66/198

(Continued)

*Primary Examiner* — Danny Worrell
(74) *Attorney, Agent, or Firm* — Alston & Bird LLP

(57) ABSTRACT

This invention is related to a method of manufacturing a cotton weft knit fabric that is resistant to fraying, curling, and laddering. The unique fabrication method described herein generates a cotton fabric that resists edge fraying and curling when cut. As a result of the unique manufacturing method described herein, the typical garment hemming process typically used to prevent hemming and fraying in weft knit fabric is not required.

20 Claims, 1 Drawing Sheet

(56) References Cited

U.S. PATENT DOCUMENTS

| | | | | |
|---|---|---|---|---|
| 7,658,087 | B1 * | 2/2010 | McMurray | D04B 1/24 66/196 |
| 7,707,857 | B1 * | 5/2010 | McMurray | D04B 1/24 66/176 |
| 7,779,655 | B2 * | 8/2010 | Chuang | D04B 1/18 66/198 |
| 7,788,953 | B1 * | 9/2010 | McMurray | D04B 1/24 66/196 |
| 7,797,968 | B2 * | 9/2010 | Chuang | D04B 1/18 66/198 |
| 8,065,894 | B2 * | 11/2011 | Yanagi | D04B 1/18 66/169 R |
| 9,567,694 | B2 * | 2/2017 | Itoh | D03D 15/08 |
| 2004/0168479 | A1 * | 9/2004 | McMurray | D02G 3/326 66/202 |
| 2009/0019624 | A1 * | 1/2009 | Birk | D02G 3/443 2/455 |

* cited by examiner

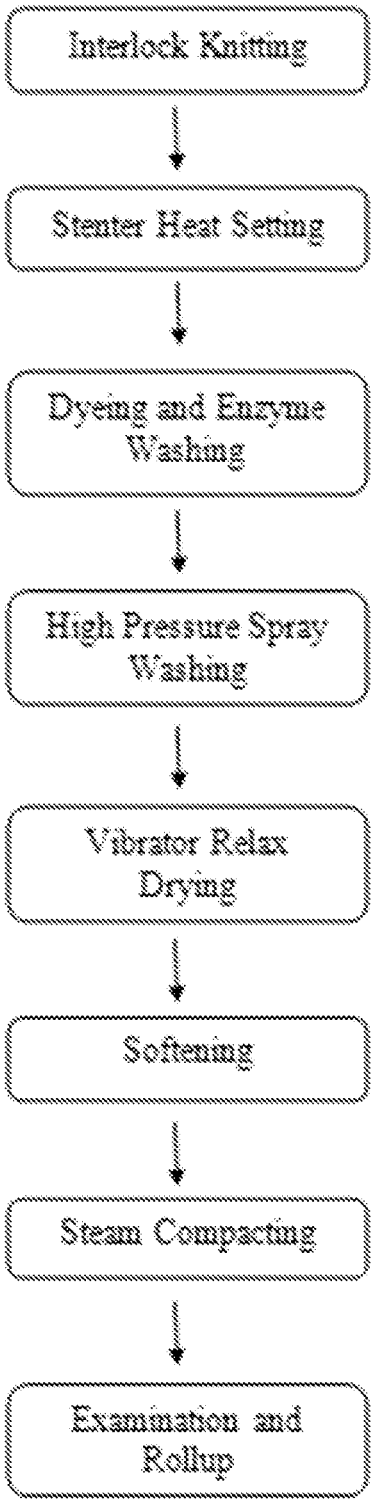
Interlock Knitting
Stenter Heat Setting
Dyeing and Enzyme Washing
High Pressure Spray Washing
Vibrator Relax Drying
Softening
Steam Compacting
Examination and Rollup

METHOD OF MANUFACTURING FRAYING-FREE COTTON ELASTANE WEFT KNIT FABRIC

CROSS-REFERENCE TO RELATED APPLICATIONS

This application claims priority under 35 U.S.C. §119 to provisional application Ser. No. 61/873,413 filed Sep. 4, 2013, which application is hereby incorporated by reference in its entirety.

FIELD OF THE INVENTION

This invention is related to a method of manufacturing a cotton weft knit fabric that is resistant to fraying, curling, and laddering.

BACKGROUND

It is well recognized that unrelaxed knitted cotton fabric exhibits a distinct tendency to curl and/or fray at the edges due to unbalanced structures at the face and the back sides of the knitted fabric (See, e.g., Hamilton, R. J., & Postle, R., *Bending and recovery properties of wool plain-knitted fabrics*, (1974) Textiles Research Journal, 44, 336-343; Spencer, D., *Knitting technology* (2001), Cambridge: Woodhead). It is theorized that a knitted fabric curls and/or frays when cut because of elastic stored energies in the fabric in terms of bending and torsion. (See Basiri, et al., *A new approach to de-curling force of single jersey weft-knitted fabric*, Journal of The Textile Institute, 2008). It is theorized that during the curling and/or fraying process, these energies are released.

In general in traditional weft knitted fabric, the cut edges are raw edges which tend to curl, ladder, and fray because nothing holds the wales together along the edge once the fabric has been cut.

Thus, in traditional weft knitted garments, to prevent this fraying and curling, post-cutting edge treatments such as sewing with over locking stitches, sewing the cut edges together with additional material such as lace, rubber material etc., and/or performing thermal treatments are performed. These additional steps require additional materials, man power, and several processing steps adding additional costs to the garment manufacturing process.

Additionally, when hemming is used to treat the cut edges in traditional weft knit garments, the area in the vicinity of the hemming will be pressed and rubbed by the wearer of the garment. This is often uncomfortable for the wearer since the area of the hemming is of a different thickness and texture than the other surfaces of the garment.

Therefore, creating a weft knitted cotton-based fabric that resists the tendency to curl and/or fray at the cut edge would be a beneficial invention with many practical applications in the garment manufacturing industry. Such a fabric would ideally be comfortable, would provide a good aesthetic appearance, and because fewer additional treatments would be necessary during the manufacturing process, would be more cost effective than traditional cotton-based garment manufacture.

DESCRIPTION OF THE FIGURE

FIG. 1. Flowchart of an embodiment of the present invention.

DETAILED DESCRIPTION OF THE PREFERRED EMBODIMENTS

The objectives of this invention are to resolve above-highlighted problems with traditional cotton-based weft knitted fabrics and, more specifically, to produce a weft knit cotton-based fabric that does not require hemming even after the fabric is cut into desired shapes. Many studies were conducted and many trials were performed in order to find a way to prevent curling and fraying in cotton-based weft double knit fabric. The fabric of the present invention resists fraying, laddering, and curling and is comfortable for the wearer. The present invention relates to materials, processes, and the associated technologies used to enhance the anti-curling, anti-fraying, and anti-laddering properties of cotton-based weft knitted fabrics.

To generate the fraying and curling resistant fabric of the present invention, most preferably, world superior long staple cotton fibers, preferably of a length greater than 30 mm, are used to create a very fine (60 ne-100 ne) cotton yarn with a high twist factor between about 3.2 and about 4.0. The high twist factor helps to minimize loose fibers in the yarn. Most preferably, the very fine cotton yarn has a count of between about 60 ne and about 100 ne. Alternatively, regenerated cellulose yarn such as rayon, modal, or viscose or natural yarn such as wool and silk can be used as the very fine yarn. By using very fine yarn, the aesthetic appearance of the fabric is enhanced, as is its value.

A secondary fiber yarn is fed together with the very fine cotton yarn in an interlock knitting machine so as to create double knit fabric loops formed by the very fine non-elastic yarn (cotton) on both the external and internal surfaces of the fabric, while the loops created by the secondary fiber (preferably elastane (also known as spandex)) are arranged on both inner surfaces of the fabric. The secondary fiber yarn most preferably comprises elastane fiber yarn. Other fiber yarns such as elaspan, Lycra®, or a similar-type fiber yarn can also be used as the secondary fiber. The linear mass density of the secondary fiber is preferably between about 17—about 44 decitex and is most preferably between about 22 decitex—about decitex.

The very fine cotton yarn is fed in parallel with the secondary yarn in an interlock knitting machine. This interlock knitting process allows the secondary fiber yarn to form its loops on the inner side of the double jersey fabric and the very fine cotton yarn to form its loops on the external surfaces of the double jersey fabric.

The yarn feeding tension should be adjusted to make stable conditions, so that knit fabric can be knitted with constantly adjusted yarn feeding tension.

The very fine cotton yarn and secondary fiber yarn are tightly knitted together using an interlock knitting machine. In a preferred embodiment, the interlock machine is a 24 gauge interlock knitting machine. In a preferred embodiment, the knitting machine is run smoothly at between about 20 RPM and about 25 RPM due to the yarn strength and so that there is no blocking of the yarn path with loose fibers. In a preferred embodiment, the compactness of the loops of the fabric after the interlock knitting has occurred is between about 55 and about 58 wales per inch.

The interlock fabric structure provides front and back surfaces with identical configurations. These identical configurations provide smooth surfaces and appropriate stretch properties in the fabric. It is highly preferable to maintain the same fabric tension at take down and to carefully monitor the courses and wales to make sure that there is consistency in the fabric at this stage.

After interlock knitting is complete, the secondary fiber makes up between about 10% to about 30% by weight of the fabric the very fine cotton yarn makes up between about 70% to about 90% by weight of the fabric. Most preferably, this secondary fiber consists of between about 10%—about 15% by weight of the fabric composition and the very fine cotton yarn makes up about 85%—about 90% by weight of fabric composition. When higher amounts of the secondary fiber, such as 50% by weight are used, the resulting fabric composition did not display the unexpected results of resisting fraying and curling when cut that were shown by the about 10% to about 30% range of secondary fiber. The same is true for lower ranges. For example, when only 2% of the secondary fiber is used, the resulting fabric composition did not display the unexpected results of resisting fraying and curling when cut that were shown by the about 10% to about 30% range of secondary fiber.

In a preferred embodiment the fabric is relaxed by steaming before being pre-set. More specifically, in this preferred embodiment, the interlock fabric obtained is preferably processed with a steaming process in the pin chain frame before being fed into the stenter machine heat chambers.

The fabric is then pre-set using a seven-chambered stenter machine set with chamber temperatures between about 180° C. and about 205° C. Most preferably, the thermal fusion of the secondary fiber occurs at a temperature of 200° C. Preferable curing hold time is between about 15 s and about 25 s.

During presetting it is preferable not to apply additional width-wise tension to the fabric in order to maintain width-wise fabric compactness. This helps allow the fabric to become properly bound during pre-setting in such a way as to control and prevent a running of the loops known as laddering.

With heat setting temperatures below about 180° C., the effect of heat setting is not always sufficient prevent the fraying and curling problems described above. When the heat setting temperature exceeds about 205° C., it is likely that fabric properties would be degraded.

It is theorized that during the pre-setting process, the secondary fibers, which have been brought closely together in the interlock process are thermally fused. This thermal fusion process allows the fabric, once cut, to resist the normal unraveling and curling that is associated with cut cotton fabrics.

Fabric consistency plays a major role in ensuring that the pre-setting process provides the desired results in the fabric. Therefore, it is important to monitor the compactness, density, and stretch properties of the fabric during the process.

Following the pre-setting process, the fabric is optionally dyed and preferably, but also optionally, treated with a concentrated enzyme to reduce stray fibers protruding from the pre-set fabric. In a preferred embodiment, Novozyme Cellusoft Combi 9800 L treatment is used in this treatment process.

Next, the fabric is optionally but preferably spread out and sprayed with high-pressure water to remove any remaining loose fibers from the fabric.

Subsequent to the optional high-pressure washing stage, the fabric can be optionally, but preferably relax dried as to improve the compactness of the fabric. When carrying out this optional relax drying process, it is preferable to use a relax belt dryer with vibrator set at about 1000 RPM and hot air nozzles set with gradual increase starting from about 35 mm to about 50 mm to release majority of the tension that occurred during previous processes, specifically dyeing and slitting.

In another optional, but preferable embodiment of the present innovation, the fabric is treated with a hydrophilic silicon softener with cationic softener to improve comfort of the wearer.

Compacting with steaming is also optional but preferable in order to further improve the compactness of the fabric. Felt of the machine set at 4 bar pressure with shoe angle of between about 20%—about 30% and temperature of the cylinder being set at about 120° C.—about 130° C. can be used for this process. Due to the about 15%—about 25% of over feeding, further tensions were released in the length direction. This step helped the finished fabric to remain relaxed and without curling after being cut.

Surprisingly and unexpectedly, the cotton-based fabric generated by the above-stated process resists fraying or curling when cut.

These unique and unexpected properties of the fabric of the present invention allow for exciting and important practical applications. Because of these unique and unexpected properties, the fabric of the present invention has many useful applications, including the manufacture of raw cut garments without the need for a hemming process. For example, because the fabric can be cut without curling or fraying, it is not necessary to attach a binding or an elastic waistband on the free edges of the fabric as in traditional cotton fabrics. Similarly, the fraying-free cotton interlock weft knitted fabric described herein does not require a hemming process traditionally used on many garments. This remarkable result allows for cotton fabric in garments that can be manufactured without traditional wide seams or bulky elastics allowing wearers to be more comfortable while wearing the fabric.

Applications of this fraying-free cotton fabric are contemplated for many garment applications, including, but not limited to men and women's undergarments, women's intimate apparel and dresses, men's and women's shirts, pants, coats, socks and many other articles of clothing.

EXAMPLE

A 24 gauge, 34 inch diameter interlock knitting machine made by Santec Precision Machinery Co., Ltd was used with a 1/80Ne cotton yarn knitted with 1/22 decitex polyurethane elastic yarn made by Invista. Each yarn was fed together with positive feeders in both the dial and cylinder of the machine. Cotton yarns appeared in both external surfaces of the knitted fabric and elastane yarn is arranged on both inner surface with elastane stitch length of 0.95 mm and cotton yarn with stitch length of 2.55 mm. Tension was set at 2-3 g and 5-6 g respectively for the cotton yarn and elastane yarn. These knitting settings allowed the fabric to remain in its optimum elastane percentage of 12% which made fabric bond at its best level without disturbing the natural recovery of the fabric. Thereafter presetting was done at 200° C. with a curing hold time of 20 seconds. Steam was used to relax the Greige before presetting the fabric. This helped release tension generated during knitting and other processes. The pre-set fabric was then bio polished using Novozyme Cellusoft Combi 9800L enzyme and dyed in a Thies ecosoft machine. After dyeing, slitting, open width water spraying, and relax drying processes, a steam compacting process was used to make the fabric relaxed, balanced, and compact. An inspection exam machine with "J" box was used for inspection to maintain tensions at a minimum level.

That which is claimed:

1. A method of generating a fray-resistant and curl-resistant weft knit cotton-based blended fabric comprising:

a. providing a very fine cotton yarn with a count between 80 ne and 100 ne and a twist factor between 3.5 and 4.0;

b. providing a secondary fiber yarn with a linear mass density between 17 and 22 decitex;

c. interlock knitting said very fine cotton yarn and said secondary fiber yarn to create a blended fabric such that said very fine cotton yarn makes up between 85% and 90% by weight of said fabric and said secondary fiber yarn makes up between 10% and 15% by weight of said blended fabric; and d. pre-setting said blended fabric at a temperature between 180° C. and 205° C.

2. The method of claim 1 wherein said very fine cotton yarn has a count of 80 ne.

3. The method of claim 2 wherein said secondary fiber yarn comprises elastane yarn.

4. The method of claim 3 wherein said elastane yarn has a linear mass density of 22 decitex.

5. The method of claim 4 wherein said very fine cotton yarn makes up 88% of said blended fabric and said secondary fiber yarn makes up 12% of said blended fabric.

6. The method of claim 5 wherein said pre-setting occurs at a temperature of 200° C.

7. The method of claim 6 wherein the curing hold time of said pre-setting is between 15 and 25 seconds.

8. The method of claim 7 wherein said blended fabric is additionally dyed and washed.

9. The method of claim 1 wherein said blended fabric has a knitting stitch length of 2.55 millimeters.

10. The method of claim 1 wherein the tension of said very fine cotton yarn is between 2 and 3 g.

11. The method of claim 1 wherein the tension of said secondary fiber is between 5 and 6 g.

12. The method of claim 1 wherein the weight of said blended fabric is between 175 and 185 grams per square meter.

13. The method of claim 1 wherein the width of said blended fabric is between 105 and 115 cm.

14. The method of claim 1 wherein said blended fabric has between 55 and 60 wales per inch.

15. The method of claim 1 wherein said blended fabric is steamed and compacted before being pre-set.

16. The method of claim 1 wherein said blended fabric is not stretched before presetting.

17. The method of claim 8 wherein said blended fabric width is 127 cm.

18. The method of claim 8 wherein said blended fabric width is 122 cm.

19. The method of claim 8 wherein said blended fabric width is 117 cm.

20. A method of generating a fray-resistant and curl-resistant weft knit cotton-based blended fabric comprising:

a. providing a very fine cotton yarn with a count between 60 ne and 100 ne and a twist factor between 3.2 and 4.0;

b. providing a secondary fiber yarn with a linear mass density between 17 and 44 decitex;

c. interlock knitting said very fine cotton yarn and said secondary fiber yarn to create a blended fabric such that said very fine cotton yarn makes up between 70% and 90% by weight of said fabric and said secondary fiber yarn makes up 10% and 30% by weight of said blended fabric; and d. pre-setting said blended fabric at a temperature between 180° C. and 205° C.

* * * * *